US012167821B2

(12) United States Patent
Park et al.

(10) Patent No.: US 12,167,821 B2
(45) Date of Patent: Dec. 17, 2024

(54) DISH WASHER

(71) Applicant: LG Electronics Inc., Seoul (KR)

(72) Inventors: Dong Hwi Park, Seoul (KR); Kyung Rae Kim, Seoul (KR); Myungwon Ko, Seoul (KR)

(73) Assignee: LG Electronics Inc., Seoul (KR)

( * ) Notice: Subject to any disclaimer, the term of this patent is extended or adjusted under 35 U.S.C. 154(b) by 168 days.

(21) Appl. No.: 17/891,710

(22) Filed: Aug. 19, 2022

(65) Prior Publication Data

US 2023/0068193 A1 Mar. 2, 2023

(30) Foreign Application Priority Data

Aug. 20, 2021 (KR) ..... 10-2021-0110409

(51) Int. Cl.
*A47L 15/42* (2006.01)

(52) U.S. Cl.
CPC ..... *A47L 15/4272* (2013.01)

(58) Field of Classification Search
CPC ..... A47L 15/4272
USPC ..... 312/228
See application file for complete search history.

(56) References Cited

U.S. PATENT DOCUMENTS 5,860,436 A * 1/1999 Hobday ..... A47L 15/4261 68/3 R
5,992,954 A * 11/1999 Becker ..... A47L 15/4272 312/228
2003/0098634 A1* 5/2003 Flowers ..... A47L 15/4272 312/228
2013/0069506 A1* 3/2013 Bennett ..... A47L 15/4219 312/228
2014/0028165 A1* 1/2014 Becker ..... A47L 15/427 312/228
2014/0216509 A1 8/2014 Cetinkaya et al.
2017/0209018 A1* 7/2017 Bhajak ..... A47L 15/4246
2020/0221921 A1 7/2020 Ham et al.

FOREIGN PATENT DOCUMENTS

CN 107348927 11/2017
CN 107788930 3/2018
CN 107970013 5/2018
CN 112515601 3/2021
KR 10-2014-0028165 A 3/2014

(Continued)

OTHER PUBLICATIONS

Office Action in Korean Appln. No. 1020220143445, mailed on Jul. 17, 2023, 8 pages (with English translation).

(Continued)

*Primary Examiner* — Matthew W Ing
(74) *Attorney, Agent, or Firm* — Fish & Richardson P.C.

(57) ABSTRACT

A dishwasher includes an additional function module that is disposed at and fixed to a front upper frame reinforcing the upper side of an open front surface of a tub, without a fixing frame exclusive for the function module, thereby ensuring a simple structure and a reduction in manufacturing costs. A mutual coupling structure is formed between the front upper frame and a front side frame reinforcing the sides of the open front surface of the tub, to readily determine the positions of the front upper frame and the front side frame, thereby ensuring a simple manufacturing process.

19 Claims, 13 Drawing Sheets

(56) References Cited

FOREIGN PATENT DOCUMENTS

| | | |
|---|---|---|
| KR | 10-2018-0034547 A | 8/2019 |
| KR | 102046339 | 11/2019 |
| KR | 20190127373 | 11/2019 |
| KR | 20200009239 | 1/2020 |
| KR | 20210001345 | 1/2021 |
| WO | WO 2011/003714 | 1/2011 |

OTHER PUBLICATIONS

Extended European Search Report in European Appln. No. 22191055.7, dated Jan. 30, 2023, 8 pages.
Notice of Allowance in Korean Appln. No. 10220143445 mailed on Nov. 6, 2023, 6 pages (with English translation).

* cited by examiner

DISH WASHER

CROSS-REFERENCE TO RELATED APPLICATIONS

This application claims the benefit of Korean Patent Application No. 10-2021-0110409, filed on Aug. 20, 2021. The disclosure of the prior application is incorporated by reference in its entirety.

TECHNICAL FIELD

Disclosed herein is a dishwasher, and in particular, a dishwasher in which an additional function module is disposed at and fixed to a front upper frame reinforcing the upper side of an open front surface of a tub, without a fixing frame exclusive for the function module, thereby ensuring a simple structure and a reduction in manufacturing costs.

BACKGROUND

Dishwashers spray wash water such as water to objects to be washed such as cooking vessels, cooking tools and the like, which are stored therein, and wash them. At this time, detergent can be included in the wash water used for a wash.

Ordinary dishwashers include a tub forming a wash space, a storage part accommodating objects to be washed in the tub, a spray arm spraying wash water to the storage part, and a sump storing water and supplying wash water to the spray arm.

Dishwashers help users to spend less time and efforts washing objects to be washed such as cooking vessels and the like after meals, enhancing user convenience.

Ordinary dishwashers perform a washing process of washing objects to be washed, a rinsing process of rinsing the objects to be washed, and a drying process of drying the objects to be washed after the washing and rinsing processes.

The washing, rinsing and drying processes and the like are all carried out in the tub.

The tub has wash pace therein, and its front surface is entirely open to easily withdraw objects to be washed while its upper, lower, left, right and rear surfaces are mostly closed.

To reinforce the front surface of the tub, having less rigidity than the other surfaces, ordinarily, an upper frame is disposed at the upper side of the front surface of the tub, and a side frame is disposed on both sides of the front surface of the tub.

At this time, the upper frame can be disposed to extend along the edge of the upper side of the front surface of the tub in the left-right direction, and the side frame can be disposed to extend along the edges of both sides of the front surface of the tub in the up-down direction.

As a related art, the configuration of a dishwasher is disposed in KR Patent Publication No. 10-2019-0127373 (document 001), and the dishwasher is provided with an upper frame and a side frame that are disposed at the front surface side of a tub.

The upper frame of the dishwasher disclosed in document 001 has a structure that can only reinforce the upper side of the open front surface of the tub but not perform additional functions. Ordinarily, function modules, which perform the functions of locking a door, sensing the position of the door, or automatically opening the door and the like, are disposed near the front surface of the tub. However, the upper frame in document 001 does not suggest a structure for accommodating or coupling the function modules, and an additional fixing frame for fixing the function modules is required.

The upper frame and the side frame of dishwasher in document 001 are not provided with a means for their mutual coupling.

Thus, at a time of assembling the upper frame and the side frame to the tub, a tool for determining the position of the upper frame and a tool for determining the position of the side frame need to be provided individually, and fastening means for coupling the upper frame and the side frame respectively to the tub need to be provided individually.

PRIOR ART DOCUMENT

Patent Document (Document 001) KR Patent No. 10-2019-0127373

SUMMARY

Technical Problems

To solve the above-described problems, the first objective of the present disclosure is to provide a dishwasher in which a function module performing at least any one of the functions of locking a door, sensing the position of a door or automatically opening a door is disposed at and fixed to a front upper frame reinforcing the upper side of an open front surface of a tub, without a fixing frame exclusive for the function module, thereby ensuring a simple structure and a reduction in manufacturing costs.

The second objective of the present disclosure is to provide a dishwasher in which a mutual coupling structure is formed between the front upper frame reinforcing the upper side of the open front surface of the tub and a front side frame reinforcing the sides of the open front surface of the tub, to readily determine the positions of the front upper frame and the front side frame, thereby ensuring a simple manufacturing process, and to minimize the number of fastening means for fastening the front upper frame and the front side frame to the tub, thereby ensuring a reduction in manufacturing costs.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

A dishwasher according to the present disclosure includes a case; a tub being accommodated in the case, and having a wash space a front surface of which is open; and a front upper frame being disposed above an upper surface of the tub, and reinforcing an upper end of the open front surface of the tub, wherein the front upper frame includes a horizontal extension part being coupled to the upper surface of the tub, and extending from a left surface of the tub to a right surface of the tub across the tub in a left-right direction; a first perpendicular extension part extending downward from a left end portion of the horizontal extension part; and a second perpendicular extension part extending downward from a right end portion of the horizontal extension part.

The first perpendicular extension part may be integrated with the left end portion of the horizontal extension part, and the second perpendicular extension part may be integrated with the right end portion of the perpendicular extension part.

The horizontal extension part may include a base plate being attached to the upper surface of the tub, and having a flat plate shape a front-rear width of which is less than a left-right length; a front plate bending from a front edge of the base plate upward; and a rear plate bending from a rear edge of the base plate upward, wherein the front plate and the rear plate may be integrated with the base plate.

An upward extension surface being integrated with the tub and bending upward may be provided at an upper edge of the open front surface of the tub, and the front plate of the horizontal extension part and the upward extension surface may contact each other closely.

The base plate may include a mid plate being provided between the left end portion and the right end portion; a left side plate being provided between the mid plate and the left end portion; and a right side plate being provided between the mid plate and the right end portion, wherein a front-rear width of the mid plate may be maintained as a first width constantly, and front-rear widths of the left side plate and the right side plate may be maintained as a second width constantly.

The first width may be greater than the second width.

The dishwasher may include a left connecting plate being provided between the mid plate and the left side plate, and connecting the mid plate and the left side plate; and a right connecting plate being provided between the mid plate and the right side plate, and connecting the mid plate and the right side plate, wherein front-rear widths of the left connecting plate and the right connecting plate may decrease gradually from the first width to the second width.

Additionally, instead of the front plate, a front notch part may be provided at a front edge of the mid plate and be open forward.

Instead of the rear plate, a rear notch part may be provided at a rear edge of the mid plate and be open rearward.

A left-right width of the rear notch part may be greater than a left-right width of the front notch part.

The dishwasher may further include a door being disposed at a front of the tub, and opening and closing the open front surface of the tub; and at least one of function modules embodying at least any one of functions of locking the door, sensing a position of the door or automatically opening the door, wherein at least one of the function modules may be supported by the mid palate.

At least one of the function modules may include a first function module embodying at least any one of the functions of locking the door, sensing a position of the door or automatically opening the door, and at least a portion of the first function module may be exposed forward through the front notch part.

Further, at least one of the function modules may further include a second function module embodying at least another of the functions of locking the door, sensing a position of the door or automatically opening the door, and at least a portion of the second function module may be exposed rearward through the rear notch part.

The second function module may be provided with at least one of holding hooks that protrudes rearward to fix the second function module to the front upper frame, and a holding hole into which the holding hook is inserted may be formed on the rear plate in a penetrating manner.

The first perpendicular extension part may include a first extension plate that bends from a left end portion of the base plate of the horizontal extension part, the second perpendicular extension part may include a second extension plate that bends from a right end portion of the base plate of the horizontal extension part, and a guide hole may be formed respectively on the first extension plate and the second extension plate in a penetrating manner.

The guide hole may be a track-shaped elongated hole, a front-rear width of which is greater than an up-down width.

Furthermore, an insertion hole having a rectangle shape and a greater surface area than the elongated hole may be formed respectively on the first extension plate and the second extension plate in a penetrating manner, the insertion hole may be formed further upward than the elongated hole, an upper edge of the insertion hole of the first extension plate may extend to the base plate past the left end portion of the horizontal extension part, and an upper edge of the insertion hole of the second extension plate may extend to the base plate past the right end portion of the horizontal extension part.

The dishwasher may further include a first front side frame being disposed on a left surface of the tub, and reinforcing a left end of the open front surface of the tub; and a second front side frame being disposed on a right surface of the tub, and reinforcing a right end of the open front surface of the tub, wherein the first front side frame and the second front side frame respectively may have a position determination bead that is inserted into the guide hole.

The first front side frame may include a first base plate being fastened to the left surface of the tub and having a flat plate shape; and a first front plate and a first rear plate bending respectively from a front edge of the first base plate and a rear edge of the first base plate, and extending in a direction where the first front plate and the first rear plate move away from the tub, and the second front side frame may include a second base plate being fastened to the left surface of the tub and having a flat plate shape; and a second front plate and a second rear plate bending respectively from a front edge of the second base plate and a rear edge of the second base plate, and extending in a direction where the second front plate and the second rear plate move away from the tub, wherein an upper end portion of the first base plate and an upper end portion of the second base plate may respectively pass through the insertion hole at least partially and protrude upward.

The case may include a first side case covering the left surface of the tub; and a second side case covering the right surface of the tub, wherein an upper end portion of the first front plate and an upper end portion of the first rear plate may be coupled to the first side case and support the first side case at least with respect to a direction of gravity, and an upper end portion of the second front plate and an upper end portion of the second rear plate may be coupled to the second side case and support the second side case at least with respect to the direction of gravity.

Advantageous Effects

In a dishwasher according to the present disclosure, a function module performing at least any one of the functions of locking a door, sensing the position of a door or automatically opening a door may be disposed at and fixed to a front upper frame reinforcing the upper side of an open front surface of a tub, without a fixing frame exclusive for the function module, thereby ensuring a simple structure and a reduction in manufacturing costs.

In the dishwasher according to the present disclosure, a mutual coupling structure may be formed between the front upper frame reinforcing the upper side of the open front surface of the tub and a front side frame reinforcing the sides of the open front surface of the tub, to readily determine the positions of the front upper frame and the front side frame, thereby ensuring a simple manufacturing process, and to minimize the number of fastening means for fastening the front upper frame and the front side frame to the tub, thereby ensuring a reduction in manufacturing costs.

Specific effects are described along with the above-described effects in the section of detailed description.

BRIEF DESCRIPTION OF DRAWINGS

The accompanying drawings constitute a part of the specification, illustrate one or more embodiments in the disclosure, and together with the specification, explain the disclosure, wherein.

DETAILED DESCRIPTION

Figure 1:
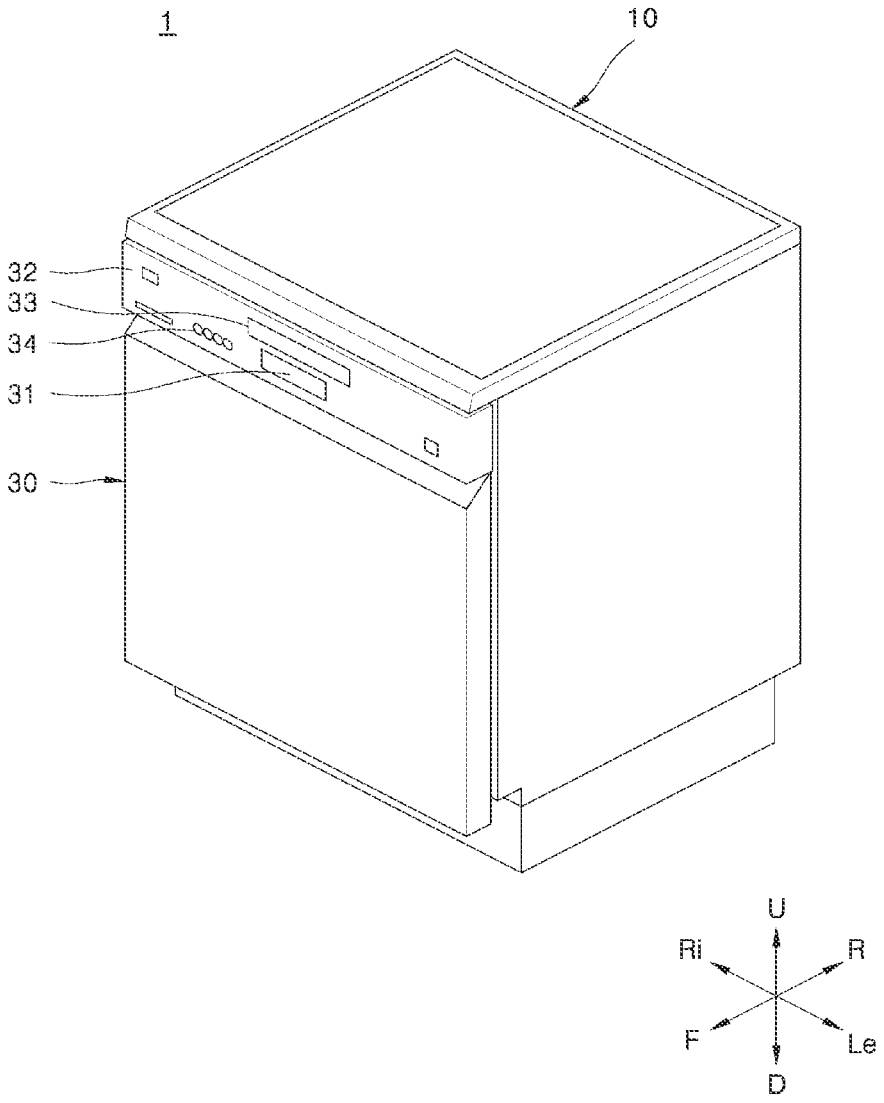
FIG. 1 is a front perspective view showing a dishwasher of one embodiment.

The above-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Below, preferred embodiments according to the disclosure are specifically described with reference to accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

When one component is described as being "on (or under)" another component, one component can be directly on or under another component, and an additional component can be interposed between the two components.

When any one component is described as being "connected", "coupled", or "connected" to another component, any one component can be directly connected or coupled to another component, but an additional component can be "interposed" between the two components or the two components can be "connected", "coupled", or "connected" by an additional component.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Hereafter, a dishwasher 1 of the embodiment according to the present disclosure is described with reference to the drawings showing the configuration of the dishwasher 1.

[Entire Structure of Dishwasher]

Hereafter, the entire structure of a dishwasher of one embodiment is described with reference to the accompanying drawings.

Figure 2:
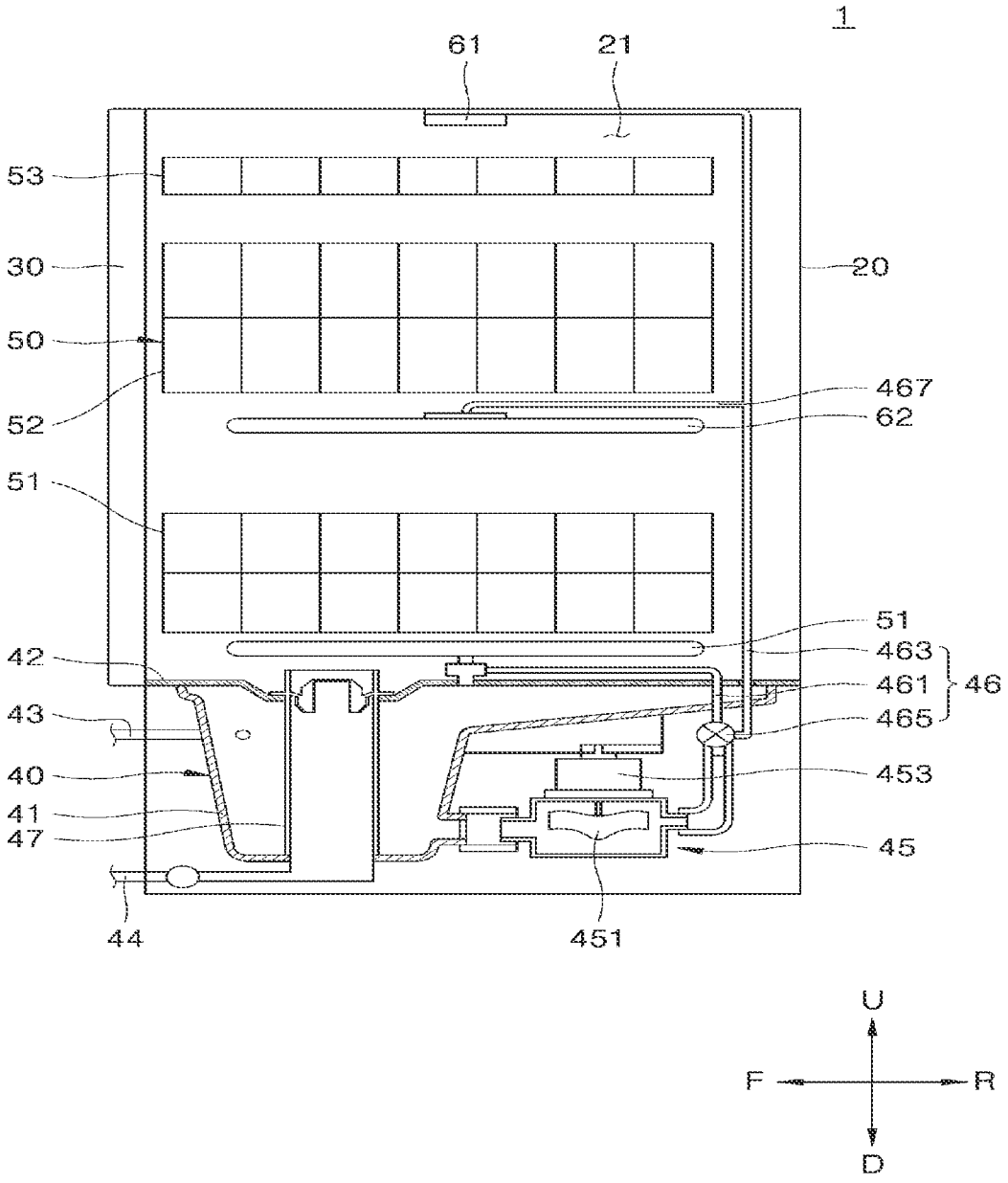
FIG. 2 is a schematic cross-sectional view showing the dishwasher in FIG. 1.

FIG. 1 is a front perspective view showing a dishwasher according to the present disclosure, and FIG. 2 is a schematic cross-sectional view showing the inner structure of the dishwasher according to the present disclosure.

As illustrated in FIGS. 1 to 2, the dishwasher 1 according to the present disclosure includes a case 10 forming the exterior of the dishwasher 1, a tub 20 being installed in the case, 10 forming a wash space 21 in which objects to be washed is washed, and having a front surface which is open, a door 30 opening and closing the open front surface of the tub 20, a driving part 40 being disposed in the lower portion of the tub 20 and supplying, collecting and circulating and draining wash water for washing objects to be washed, a storage part 50 being detachably provided in the wash space 21 of the tub 20 and allowing objects to be washed to be mounted, and a spray part 60 being disposed near the storage part 50 and spraying wash water for washing objects to be washed.

At this time, the objects to be washed, mounted in the storage part 50, may be cooking vessels such as bowls, dishes, spoons, chopsticks, and the like, and other cooking tools, for example. Hereafter, the objects to be washed are referred to as cooking vessels, unless mentioned otherwise.

The tub 20 may be formed into a box the front surface of which is open entirely, and may be a so-called tub.

The tub 20 may have a wash space 21 therein, and its open front surface may be opened and closed by the door 30.

The tub 20 may be formed in a way that a metallic plate having strong resistance against high-temperature and moisture, i.e., a stainless steel plate is press-processing.

Additionally, the tub 20 may be provided with a plurality of brackets in the inner surfaces of the tub 20, and the plurality of brackets allow the components such as a storage part 50, a spray part 60 and the like, which are described below, to be supported and installed in the tub 20.

The driving part 40 may include a sump 41 storing wash water, a sump cover 42 separating the sump 41 from the tub 20, a water supply part 43 supplying wash water to the sump 41 from the outside, a drain part 44 discharging wash water of the sump 41 to the outside, and a water supply pump 45 and a supply channel 46 for supplying wash water of the sump 41 to the spray part 60.

The sump cover 42 may be disposed at the upper side of the sump 41, and separate the sump 41 from the tub 20. Additionally, the sump cover 42 may be provided with a plurality of return holes for returning wash water, having sprayed to the wash space 21 through the spray part 60, to the sump 41.

That is, wash water having sprayed toward cooking vessels from the spray part 60 may fall to the lower portion of the wash space 21 and return to the sump 41 again through the sump cover 42.

The water supply pump 45 may be disposed in a lateral portion or the lower portion of the sump 41, and pressurize and supply wash water to the spray part 60.

One end of the water supply pump 45 may connect to the sump 41, and the other end may connect to the supply channel 46. The water supply pump 45 may be provided with an impeller 451, a motor 453 and the like, therein. As power is supplied to the motor 453, the impeller 451 may rotate, and wash water of the sump 41 may be pressurized and then supplied to the spray part 60 through the supply channel 46.

The supply channel 46 may selectively supply the wash water supplied by the water supply pump 45 to the spray part 60.

For example, the supply channel 46 may include a first supply channel 461 connecting to a lower spray arm 61, and a second supply channel 463 connecting to an upper spray arm 62 and a top nozzle 63, and the supply channel 46 may be provided with a supply channel diverting valve 465 selectively opening and closing the supply channels 461, 463.

At this time, the supply channel diverting valve 465 may be controlled to allow each of the supply channels 461, 463 to be opened consecutively or simultaneously.

The spray part 60 is provided to spray wash water to cooking vessels and the like stored in the storage part 50.

Specifically, the spray part 60 may include a lower spray arm 61 being disposed in the lower portion of the tub 20 and spraying wash water to a lower rack 51, an upper spray arm 62 being disposed between the lower rack 51 and an upper rack 52 and spraying wash water to the lower rack 51 and the upper rack 52, and a top nozzle 63 being disposed in the upper portion of the tub 20 and spraying wash water to a top rack 53 or the upper rack 52.

In particular, the lower spray arm 61 and the upper spray arm 62 may be provided in the wash space 21 of the tub 20, and spray wash water toward cooking vessels in the storage part 50 while rotating.

The lower spray arm 61 may be rotatably supported at the upper side of the sump cover 42 such that the lower spray arm 61 sprays wash water to the lower rack 51 under the lower rack 51 while rotating.

Additionally, the upper spray arm 62 may be rotatably supported by a spray arm holder 467 such that the upper spray arm 62 sprays wash water while rotating between the lower rack 51 and the upper rack 52.

The tub 20 may further have a reflection plate on a lower surface 25 thereof, to enhance washing efficiency, and the reflection plate diverts the direction of wash water having sprayed from the lower spray arm 61 in an upward direction (a U-direction).

Since a well-known configuration can be applied to the configuration of the spray part 60, detailed description of the configuration of the spray part 60 is omitted hereafter.

The storage part 50 may be provided in the wash space 21, and store coking vessels.

The storage part 50 may be withdrawn through the open front surface of the tub 20 from the inside of the tub 20.

For example, FIG. 2 shows an embodiment provided with a storage part including a lower rack 51 that is disposed in the lower portion of the tub 20 and stores relatively large-sized cooking vessels, an upper rack 52 that is disposed at the upper side of the lower rack 51 and stores medium-sized cooking vessels, and a top rack 53 that is disposed in the upper portion of the tub 20 and stores small-sized cooking vessels and the like. However, embodiments are not limited to the embodiment. Hereafter, a dishwasher of an embodiment that is provided with three storage parts 50 as illustrated is described.

Each of the lower rack 51, the upper rack 52 and the top rack 53 may be withdrawn outward through the open front surface of the tub 20.

To this end, the tub 20 may have a guide rail 54 on both lateral walls thereof that form the inner circumferential surface of the tub 20, and the guide rail 54 may include an upper rail 541, a lower rail 542 and a top rail 543.

Each of the lower rack 51, the upper rack 52 and the top rack 53 may be provided thereunder with a wheel. A user may withdraw the lower rack 51, the upper rack 52 and the top rack 53 outward through the front surface of the tub 20 to easily store cooking vessels on the racks or take out the cooking vessels after a washing process.

The guide rail 54 may be provided as a fixed guide rail that guides the withdrawal and insertion of the spray part 60 in the form of a simple rail or as a stretchable guide rail which guides the withdrawal and storage of the spray part 60 and the withdrawal distance of which increases as the spray part 60 is withdrawn.

The door 30 is used for opening and closing the open front surface of the tub 20 that is described above.

Ordinarily, a hinge part (not illustrated) for opening and closing the door 30 is provided in the lower portion of the open front surface, and the door 30 is open by taking the hinge part as a rotation axis.

The door 30 may be provided with a handle 31 and a control panel 32 on the outer surface thereof. The handle 31 is used for opening the door 30, and the control panel 32 is used for controlling the dishwasher 1.

As illustrated, the control panel 32 may be provided with a display 33 that visually displays information on a current operation state and the like of the dishwasher, and a button part 34 including a selection button to which the user's selection manipulation is input, a power button to which the user's manipulation for turning on-off the power of the dishwasher is input, and the like.

The inner surface of the door 30 forms a mounting surface by which the lower rack 51 of the storage part 50 is supported as the door 30 is opened as well as forming one surface of the tub 20 as the door 30 is closed.

To this end, as the door 30 is fully opened, the inner surface of the door 30 forms a horizontal surface in the same direction where the guide rail 54, by which the lower rack 51 is guided, extends, for example.

Though not illustrated, a drying air supply part may be provided in the lower portion of the tub 20 and may generate and supplying high-temperature drying air into the tub 20. The tub 20 may be provided with at least one of drying air supply holes on at least any one of the right surface or the left surface thereof, and high-temperature drying air generated in the drying air supply part may flow into the tub through the drying air supply hole.

[Detailed Configuration of Tub and Tub Frame]

Hereafter, the detailed configurations of the above-described tub 20 and a tub frame 70 are described with reference to FIGS. 3 to 5.

The tub 20 forming the wash space 21 of the dishwasher 1 may be comprised of a plurality of parts. For example, the tub 20, as illustrated in FIGS. 3 and 4, may be comprised of three parts, but not limited. Hereafter, an embodiment in which the tub 20 is comprised of three parts is described.

A tub 20 comprised of three parts may include an upper tub 20*a* forming an upper surface 24 of the tub 20, a bottom tub 20*c* forming a lower surface 25 of the tub 20, and a mid tub 20*b* being disposed between the upper tub 20*a* and the bottom tub 20*c* and being coupled respectively to the upper tub 20*a* and the bottom tub 20*c*.

The upper tub 20*a* forming the upper surface 24 of the tub 20 may be formed in a way that a metallic plate having predetermined resistance against heat and erosion, i.e., a stainless steel plate, is press-processing.

At this time, the upper tub 20*a*'s both lateral edges and rear edge coupled to the mid tub 20*b* may be formed into a curved surface having predetermined curvature.

Additionally, the upper tub 20*a* forms the upper edge of an open front surface 22 of the tub 20. As illustrated in FIG. 4, since the open front surface 22 of the tub 20 may lack in strength, the open front surface 22 may be easily deformed by external force. To prevent the deformation of the open front surface 22, the upper tub 20*a* forming the upper edge of the front surface 22 may have an upward extension surface 221, at the front edge thereof, and the upward extension surface may extend in a flange shape.

Like the upper tub 20*a*, the bottom tub 20*c* forming the lower surface 25 of the tub 20 may be formed in a way that a metallic plate having predetermined resistance against heat and erosion, i.e., a stainless steel plate, is press-processing.

At this time, the bottom tub 20*c*'s both lateral edges and rear edge coupled to the mid tub 20*b* may be formed into a curved surface having predetermined curvature.

Additionally, the bottom tub 20*c* may have a sump hole 252 for mounting the sump that stores wash water, in the central portion thereof, and a mounting surface by which the lower rack is supported, in a lateral surface thereof.

Figure 3:
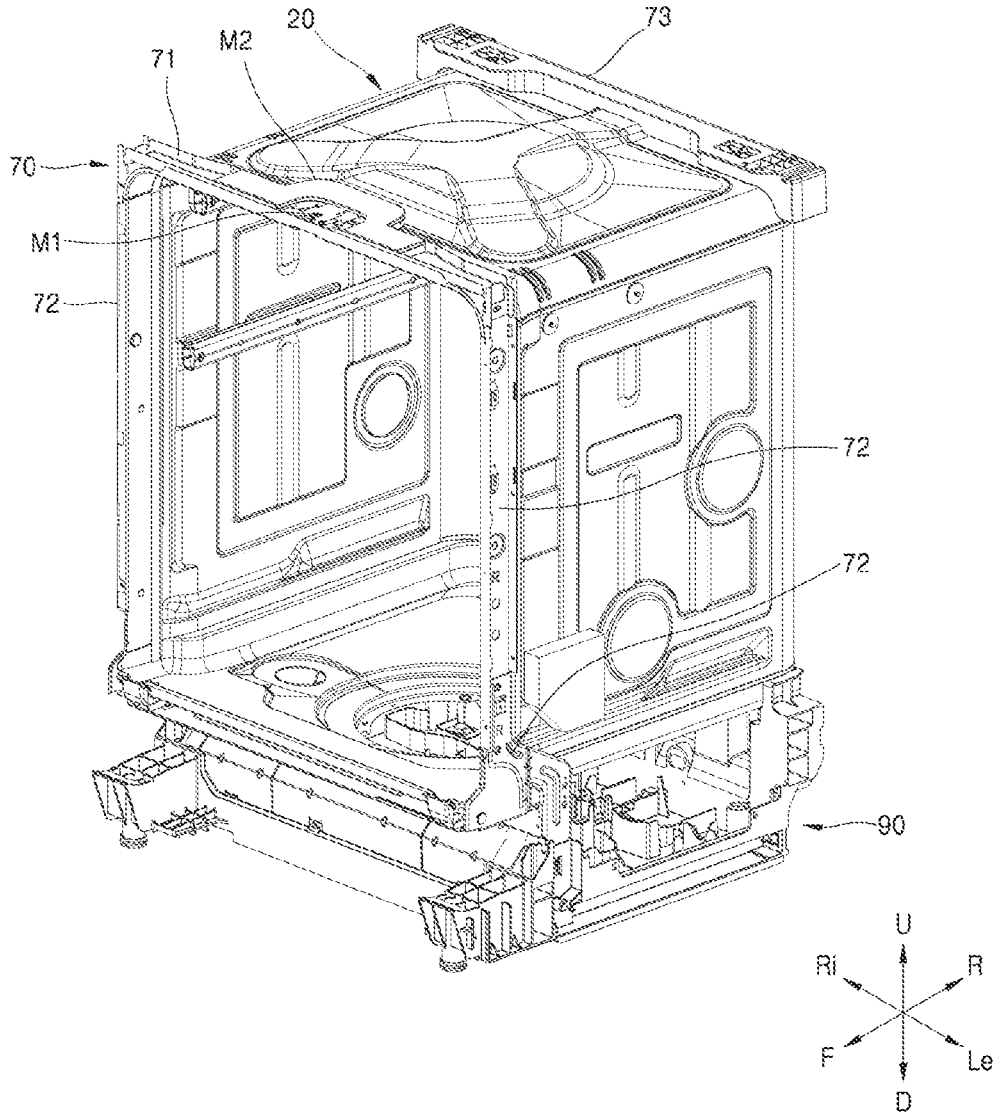
FIG. 3 is a perspective view showing the dishwasher in FIG. 1 without a door and a case.

As illustrated in FIG. 3, a base having a predetermined accommodation space therein may be coupled to the lower side of the bottom tub 20*c*.

Like the upper tub 20*a* and the bottom tub 20*c*, the mid tub 20*b* forming the tub's both lateral surfaces 26, 27 and rear surface 23 may be formed in a way that a metallic plate having predetermined resistance against heat and erosion, i.e., a stainless steel plate, is press-processing.

As illustrated, the upper tub 20*a*'s both lateral edges and rear edge may be coupled to the mid tub 20*b*'s upper edge.

Additionally, the bottom tub 20*c*'s both lateral edges and rear edge may be coupled to the mid tub 20*b*'s lower edge.

At this time, to prevent the leakage of wash water and ensure a firm coupling, the upper tub 20*a* and the mid tub 20*b*, and the mid tub 20*b* and the bottom tub 20*c* may be coupled to each other based on welding, e.g., seam welding.

As is well-known to one having ordinary skill in the art, seam welding, a sort of electric resistance welding, involves continuous spot welding based on a roller-shaped electrode, and is used for a seam requiring airtight seal or watertight seal.

The tub 20 is comprised of three parts including the upper tub 20*a*, the mid tub 20*b* and the bottom tub 20*c*. However, in the seam welding method, welding lines are on the same flat surface. Thus, the seam welding method requires less time spent for welding than the other welding methods.

The dishwasher 1 of one embodiment may be provided with a tub frame 70 that is attached to the outer surface of the tub 20.

Figure 4:
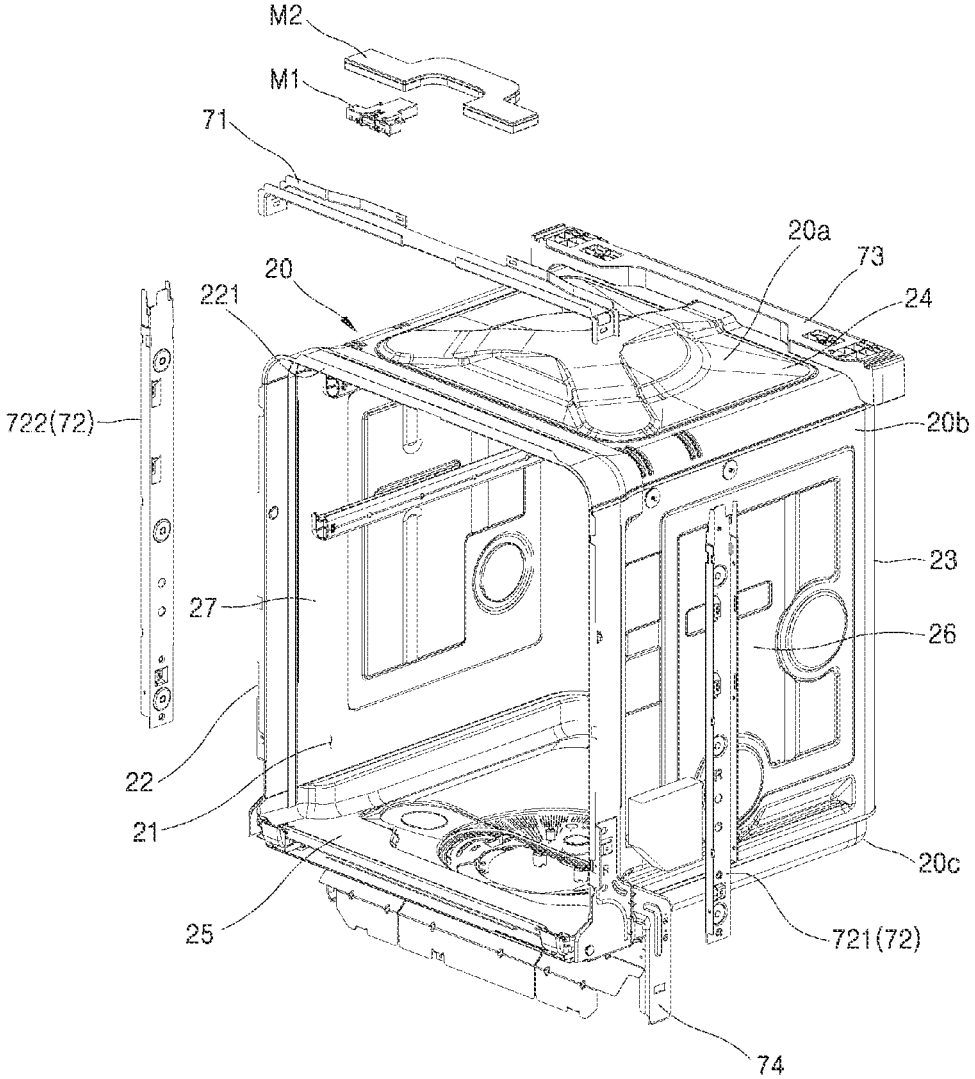
FIG. 4 is an exploded perspective view showing a tub and a tub frame in FIG. 3 separated from each other.

Specifically, as illustrated in FIGS. 3 and 4, the tub frame 70 may include a front upper frame 71 being adjacent to the open front surface 22 of the tub 20 and being attached to the upper surface 24 of the tub 20, a front side frame 72 being adjacent to the open front surface 22 of the tub 20 and being attached to the tub 20's both lateral surfaces, a support frame fastening the tub 20 and the base, and a rear upper frame being adjacent to the rear surface 23 of the tub 20 and being attached to the upper surface 24 of the tub 20.

The front upper frame 71 is disposed on the upper surface 24 of the tub 20 and reinforce the upper edge side of the open front surface 22 of the tub 20.

Specifically, the front upper frame 71 may include a horizontal extension part 711 that extends from a left surface 26 of the tub 20 to a right surface 27 of the tub 20 across the tub 20 in the left-right direction, a first perpendicular extension part 712 that extends from the left end portion of the horizontal extension part 711 in the downward direction (a D-direction) in parallel with the left surface 26 of the tub 20, and a second perpendicular extension part 713 that extends from the right end portion of the horizontal extension part 711 in the downward direction (the D-direction) in parallel with the right surface 27 of the tub 20.

Figure 5:
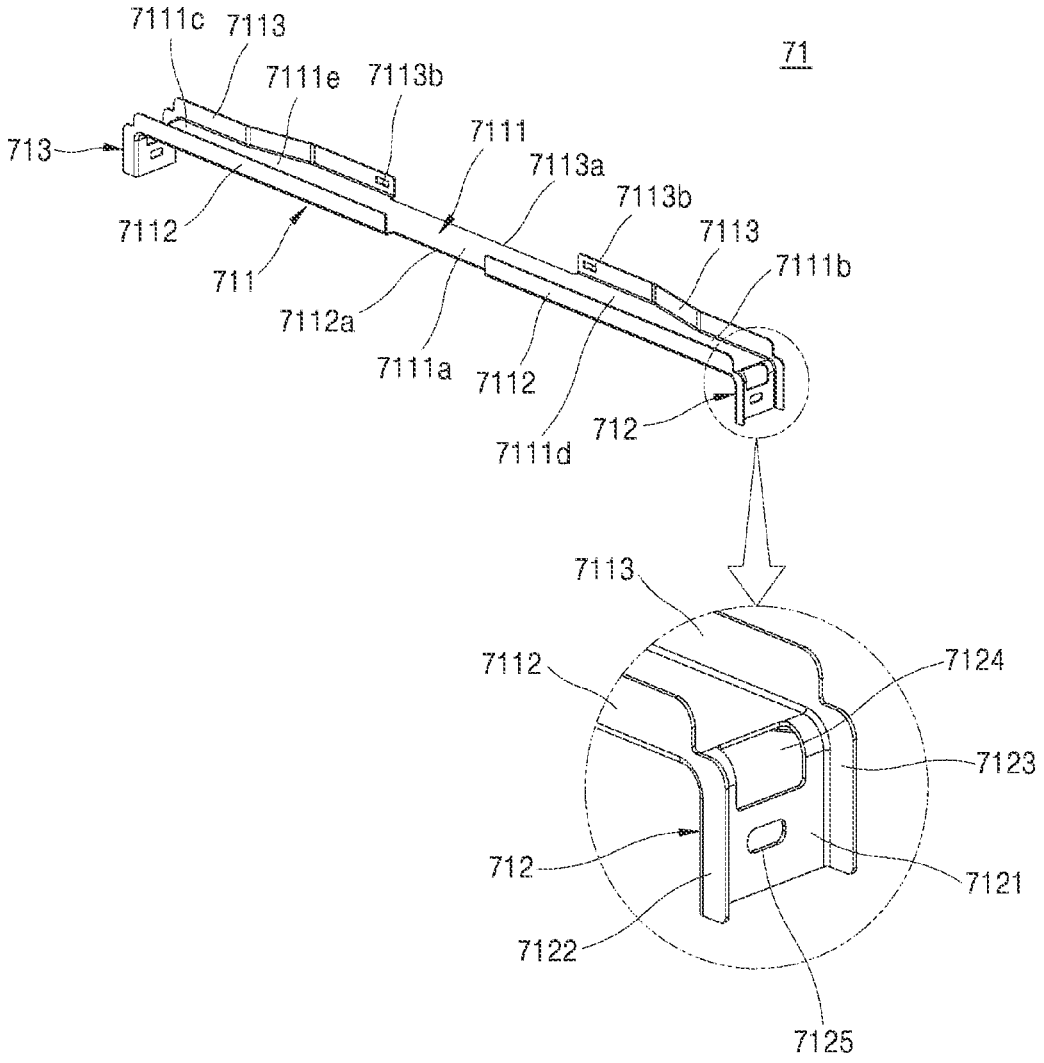
FIGS. 5 and 6 are a perspective view and a partial enlarged view showing a front upper frame of the tub frame in FIG. 4.

As illustrated in FIG. 5, the first perpendicular extension part 712 and the second perpendicular extension part 713 may be integrated with the horizontal extension part 711.

For example, the first perpendicular extension part 712 and the second perpendicular extension part 713 may integrated with the horizontal extension part 711 in a way that a metallic plate having predetermined strength and thickness is press-processing. At this time, each of the first perpendicular extension part 712 and the second perpendicular extension part 713 may be respectively formed in a way that the left end portion and the right end portion of the horizontal extension part 711 bend in the downward direction (the D-direction).

The horizontal extension part 711 reinforces the upper edge side of the open front surface 22 of the tub 20. To this end, the horizontal extension part 711 may be formed into a beam that has a ⊏-shaped cross section in a direction perpendicular to the lengthwise direction thereof.

Specifically, the horizontal extension part 711 may be disposed to directly contact the upper surface 24 of the tub 20 and include a base plate 7111 constituting the bottom surface of a ⊏-shape.

As exemplarily illustrated, the base plate 7111 may be formed into a flat surface that extends from the right surface 27 of the tub 20 to the left surface 26 of the tub 20 across the tub 20. Though not illustrated, the base plate 7111 may have a bead forming part for reinforcing its strength.

To embody the beam shape, the base plate 7111 may have a front-rear (F-R direction) width much less than a left-right (Le-Ri direction) length.

To reinforce the strength of the tub 20, the base plate 7111 may be disposed on the upper surface 24 of the tub 20 while being closest to the upper edge of the open front surface 22, and in the state of being disposed in parallel with the upper edge, may be firmly fixed to the tub 20 with methods such as welding and the like. Fixing the base plate 7111 directly to the tub 20 is referred to as actual assembly, to distinguish between the actual assembly and temporary assembly that is described hereafter.

The front plate 7112, which constitutes the front surface of the horizontal extension part 711, may be disposed to contact the upward extension surface of the above-described tub 20 as close as possible so that the base plate 7111 can be disposed closest to the upper edge of the open front surface 22 of the tub 20.

At this time, the front edge of the base plate 7111 may extend in the form of a straight line in the left-right direction (the Le-Ri direction) in response to the upward extension surface that extends in the form of a straight line in the left-right direction (the Le-Ri direction).

Figure 6:
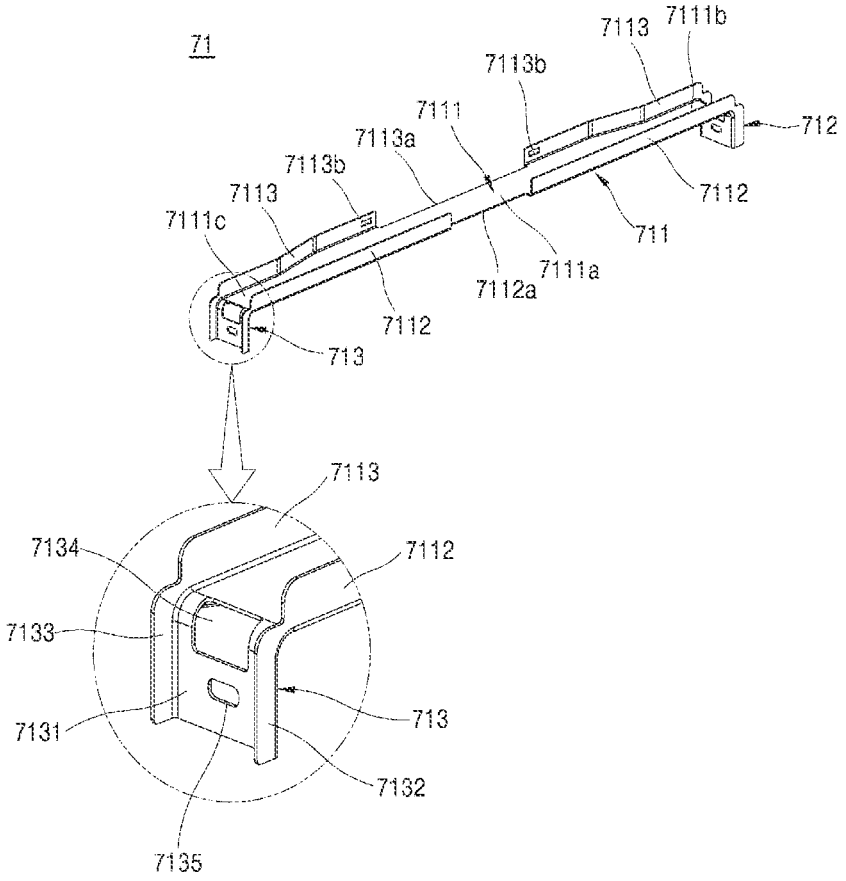
Figure 7:
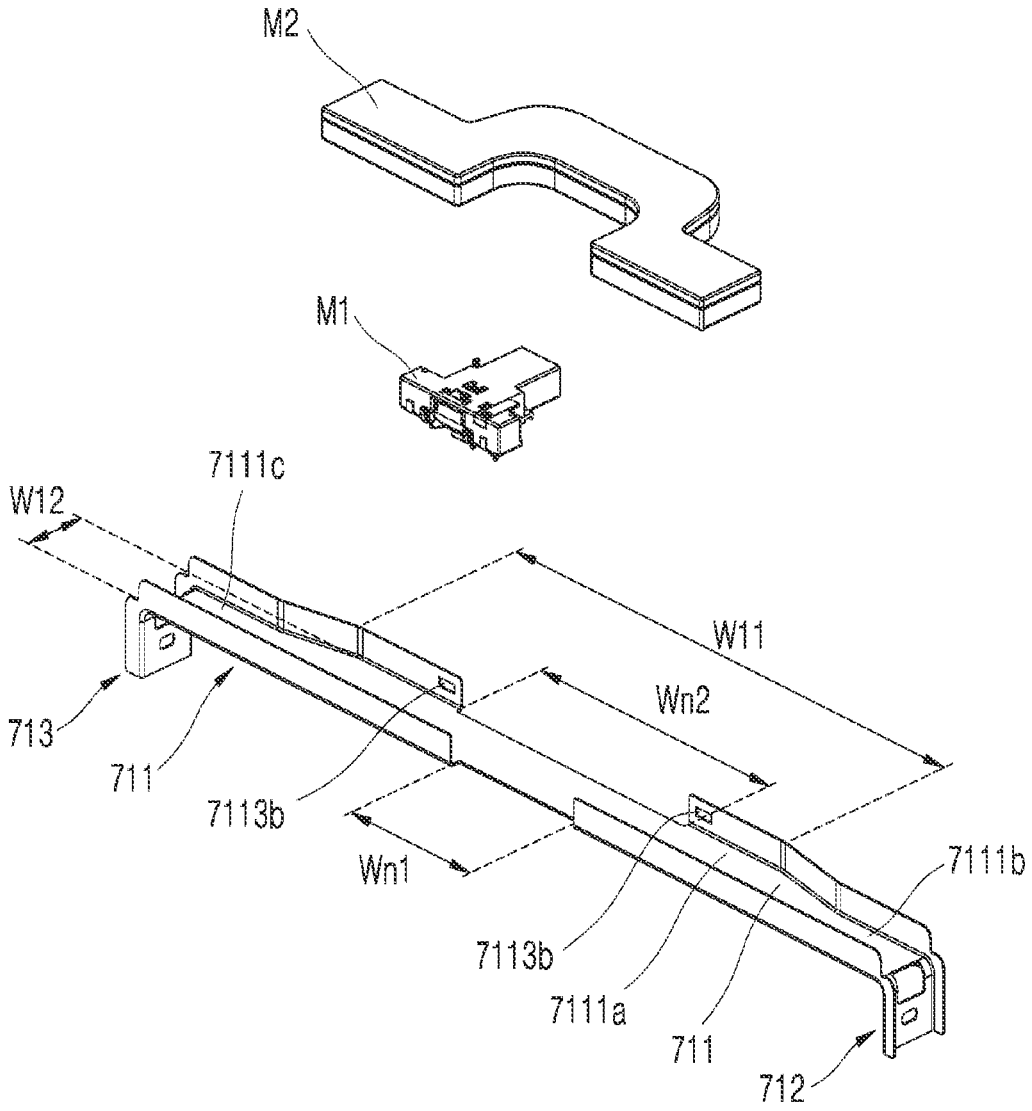
FIGS. 7 and 8 are an exploded perspective view and a combined perspective view for describing the state in which a first function module and a second function module are disposed at a front upper frame.

As illustrated in FIGS. 5 to 7, the front-rear (F-R direction) width of the base plate 7111 changes along the left-right direction (the Le-Ri direction).

That is, the mid area of the base plate 7111 may be formed to have a front-rear (F-R direction) width greater than those of the left area and the right area of the base plate 7111.

As described above, the portion, which is the mid area of the base plate 7111 and has a maximum front-rear (F-R direction) width W12, can be referred to as a mid plate 7111*a*.

A first function module M1 and a second function module M2 may be disposed and fixed on the mid plate 7111*a*, as described hereafter. Accordingly, the front-rear (F-R direction) width W12 and the left-right (Le-Ri direction) width W11 of the mid plate 7111*a* may be determined depending on the sizes and shapes of the first function module M1 and the second function module M2.

In the illustrated embodiment, the mid plate 7111*a* has a rectangle shape in which a front-rear (F-R direction) width remains constant along the left-right direction (the Le-Ri direction), but is provided as an example. The shape of the mid plate 7111*a* may vary depending on the shapes of the first function module M1 and the second function module M2 and the disposition relationship between the first function module M1 and the second function module M2.

The base plate 7111 may have a left side plate 7111*b* and a right side plate 7111*c*, at the left end side and the right end side thereof, and the left side plate 7111*b* and the right side plate 7111*c* have a front-rear (F-R direction) width less than the front-rear (F-R direction) width W12 of the mid plate 7111*a*.

Like the mid plate 7111*a*, the front-rear (F-R direction) widths of the left side plate 7111*b* and the right side plate 7111*c* may remain constant along the left-right direction (the Le-Ri direction).

Additionally, a left connecting plate 7111*d* may be provided between the mid plate 7111*a* and the left side plate 7111*b*, and connect the mid plate 7111*a* and the left side plate 7111*b*, and a right connecting plate 7111*e* may be provided between the mid plate 7111*a* and the right side plate 7111*c*, and connect the mid plate 7111*a* and the right side plate 7111*c*.

As illustrated, the left connecting plate 7111*d* and the right connecting plate 7111*e* may have a front-rear (F-R direction) width that increases gradually toward the mid plate 7111*a*.

The horizontal extension part 711 may further include a front plate 7112 that bends in the upward direction (the U-direction) from the front edge of the base plate 7111.

The front plate 7112 may be integrated with the base plate 7111, and constitute the front surface of the ⊏-shape.

The front plate 7112 may extend along the front edge of the base plate 7111 in the left-right direction (the Le-Ri direction), and the height at which the front plate 7112 protrudes in the upward direction (the U-direction) may remain constant.

As described above, the front plate 7112, constituting the front surface of the horizontal extension part 711, may be disposed to contact the upward extension part of the tub 20 as close as possible, and serve as a reference surface for determining the front-rear position of the horizontal extension part 711.

Further, as illustrated, instead of the front plate 7112, a section being open toward the front may be formed in a position corresponding to the area of the mid plate 7111*a*. The section without the front plate 7112 may be referred to as a front notch part 7112*a*. As described hereafter, the front end side of the first function module M1 may be exposed forward through the front notch part 7112*a*.

At this time, the left-right (Le-Ri direction) width Wn1 of the front notch part 7112*a* may be formed in response to the left-right (Le-Ri direction) width of the front end portion of the first function module M1. Accordingly, the left-right (Le-Ri direction) width Wn1 of the front notch part 7112*a* may be set to a width wide enough for the first function module M1 to pass through front notch part 7112*a* in the front-rear direction (the F-R direction).

Additionally, the horizontal extension part 711 may further include a rear plate 7113 that bends from the rear edge of the base in the upward direction (the U-direction).

The rear plate 7113 may be integrated with the base plate 7111 and constitute the rear surface of the ⊏ shape.

The rear plate 7113 may extend along the rear edge of the base plate 7111 in the left-right direction (the Le-Ri direction), and the height at which the rear plate 7113 protrudes in the upward direction (the U-direction) may remain constant. At this time, the height of the protrusion of the rear plate 7113 may remain the same as the height of the protrusion of the front plate 7112.

Further, as illustrated, instead of the rear plate 7113, a section being open toward the rear may be formed in a position corresponding to the area of the mid plate 7111*a*. The section without the rear plate 7113 may be referred to as a rear notch part 7113*a*. As described hereafter, the rear end side of the second function module M2 may be exposed and protrude rearward through the rear notch part 7113*a*.

At this time, the left-right (Le-Ri direction) width Wn2 of the rear notch part 7113*a* may be formed in response to the left-right (Le-Ri direction) width of the rear end portion of the second function module M2. Accordingly, the left-right (Le-Ri direction) width Wn2 of the rear notch part 7113*a* may be set to a width wide enough for the rear end portion of the second function module M2 to pass through the rear notch part 7113*a* in the front-rear direction (the F-R direction).

As illustrated in FIG. 7, when the left-right width of the rear end side of the second function module M2 is greater than the left-right width of the front end side of the first function module M1, the left-right (Le-Ri direction) width Wn2 of the rear notch part 7113*a* may be greater than the left-right (Le-Ri direction) width Wn1 of the front notch part 7112*a*.

A pair of holding grooves is formed with the rear notch part 7113*a* therebetween in a way that penetrates on the rear plate 7113, and a holding hook M22 of the second function module M2, described hereafter, is inserted into the holding groove. The holding groove serves as a fixing hole for fixing the holding hook M22. The configuration of the holding groove is described below with reference to FIG. 7.

Additionally, the first perpendicular extension part 712 and the second perpendicular extension part 713 respectively connect to the left end portion and the right end portion of the base plate 7111 of the horizontal extension part 711 in an integrated manner, and provides the functions of connecting to the below-described front side frame 72 and setting temporary assembly of the front upper frame 71 without directly contacting the tub 20 or being fixed to the tub 20.

To realize the connection function, a first guide hole 7125 may be formed on a first extension plate 7121 of the first perpendicular extension part 712 in a penetrating manner, and has a front-rear (F-R direction) width greater than an up-down (U-D direction) width, as illustrated in FIG. 5.

For example, the guide hole 7125 may be an elongated hole in the form of a track-shape.

A position determination bead 7211*b* may be provided on a first base plate 7211 of the first front side frame 721 described hereafter, and inserted into the guide hole 7125 of the first extension plate 7121.

At this time, the position determination bead 7211*b* may be a circular bead that has an outer diameter corresponding to the up-down (U-D direction) width of the guide hole 7125.

Accordingly, at a time of a coupling between the first front side frame 721 and the front upper frame 71, the up-down (U-D direction) position of the first perpendicular extension part 712 may be guided by the guide hole 7125 and the position determination bead 7211*b*.

Further, a first insertion hole 7124 having a greater surface area than the guide hole 7125 may be formed on the first extension plate 7121 of the first perpendicular extension part 712 in a penetrating manner.

In the state in which the front upper frame 71 is disposed at the tub 20, the insertion hole 7124 may be formed further upward than the guide hole 7125.

At this time, the insertion hole 7124 may be an approximate rectangle-shaped penetration hole, for example.

The lower edge of the rectangle-shaped penetration hole may be adjacent to the guide hole 7125, and extend in parallel with the guide hole 7125 in the front-rear direction (the F-R direction).

The upper edge of the penetration hole may extend to the left end portion of the base plate 7111 of the horizontal extension part 711.

The front edge and the rear edge of the penetration hole may be respectively spaced a predetermined distance apart from a front plate 7112 and a rear plate 7113 of the first perpendicular extension part 712 and formed in parallel with the front plate 7112 and the rear plate 7113.

A gap or a width between the front edge of the penetration hole and the rear edge of the penetration hole may be greater than or the same as the front-rear width of an upper end portion 7211*a* of the first base plate 7211 such that the upper end portion 7211*a* of the first base plate 7211 of the first front side frame 721 passes through the gap.

The second perpendicular extension part 713, connecting to the right end portion of the base plate 7111 of the horizontal extension part 711, may have a shape symmetrical to the first horizontal extension part 712 with respect to the above-described mid plate 7111*a*.

Thus, the second perpendicular extension part 713 may have a second insertion hole 7134 and a second guide hole 7135, having the same shape as the insertion hole 7124 and the guide hole 7125 of the first perpendicular extension part 712, in positions corresponding to those of the first perpendicular extension part 712, and have a front plate 7132 and a rear plate 7133 having the same shape as the front plate 7122 and the rear plate 7123 of the first perpendicular extension part 712. The detailed shapes of the first extension plate 7121, the front plate 7122, and the rear plate 7123 of the first perpendicular extension part 712 may also be applied to those of a second extension plate 7131, the front plate 7132 and the rear plate 7133 of the second perpendicular extension part 713.

However, unlike the first perpendicular extension part 712, the second perpendicular extension part 713 connects to a second front side frame 722.

Accordingly, a position determination bead of the second front side frame 722 may be inserted into the guide hole 7135 of the second perpendicular extension part 713, and an upper end portion 7221*a* of a second base plate 7221 of the second front side frame 722 passes through the insertion hole 7134 of the second perpendicular extension part 713 and is coupled to the second perpendicular extension part 713. Details of the second perpendicular extension part 713 identical with those of the first perpendicular extension part 712 are omitted hereafter.

As described above, the horizontal extension part 711 of the front upper frame 71 may accommodate and support the first function module and the second function module M2 in addition to reinforcing the strength of the tub 20.

The first function module M1 and the second function module M2 perform functions in relation to a door, and the functions in relation to a door may include locking a door, sensing the position of a door and automatically opening a door and other functions.

For example, the first function module M1 may be a multiple module that performs the functions of locking the door and sensing the position of the door. At this time, the second function module M2 may be a multiple module that performs the function of automatically opening the door and other functions.

Well-known configurations can be applied to detailed configurations for embodying the functions of locking a door, sensing the position of a door and automatically opening a door, and the like. Detailed description in relation to this is omitted.

Hereafter, for convenience, description is provided with reference to an embodiment where the first function module M1 performs the functions of locking the door and sensing the position of the door while the second function module M2 performs the function of automatically opening the door. However, the functions of the first function module M1 and the second function module M2 are not limited.

As describe above, both of the first function module M1 and the second function module M2 may be disposed on the horizontal extension part 711 of the front upper frame 71, and specifically, supported and fixed by the mid plate 7111*a* of the horizontal extension part 711.

The first function module M1 is smaller than the second function module M2, and needs to be disposed close to the central portion of the upper end of the rear surface of the door. The first function module M1 is disposed in the central portion of the mid plate 7111*a* with respect to the left-right direction (the Le-Ri direction).

At this time, to effectively perform the position sensing of a door, the front end portion of the first function module M1 needs to be disposed as close as possible to the door. To this end, the front end portion of the first function module M1 provided with a position sensing tool may be exposed forward through the front notch part 7112*a*.

The rear end portion of the first function module M1 may pass the rear edge of the mid plate 7111*a*, and extend by passing through the rear notch part 7113*a*.

The second function module M2 may be manufactured individually in addition to the first function module M1 and disposed on the mid plate 7111*a*, and may be formed to avoid the first function module M1.

For example, the second function module M2 may include an avoidance part M21 where a central portion bends rearward to avoid the first function module M1, and an extension part which respectively connects to both sides of the avoidance part M21.

Figure 8:
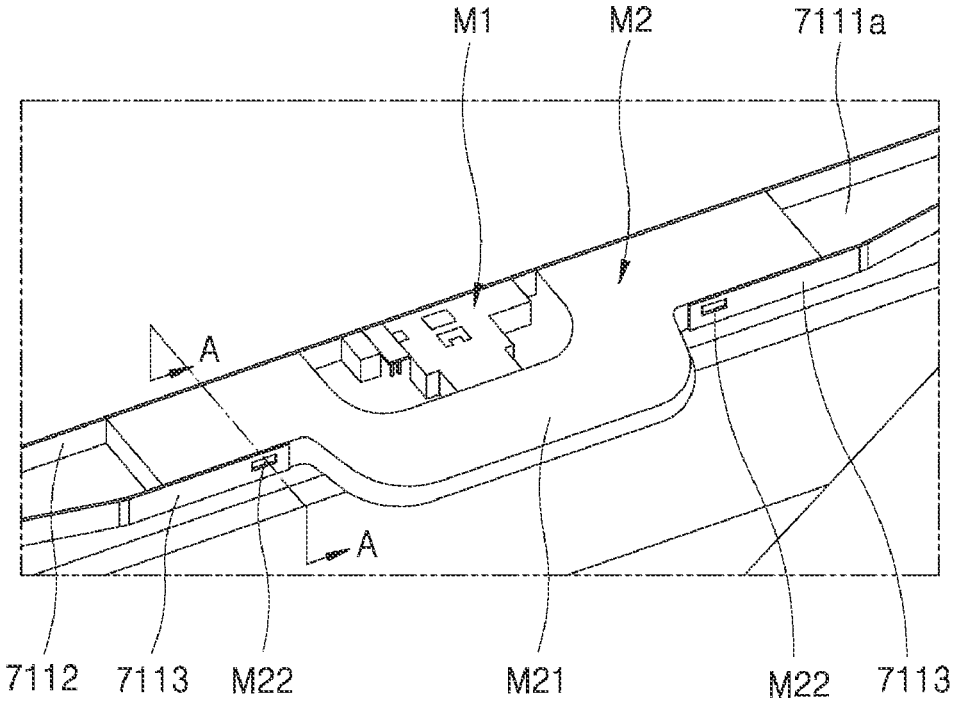

As illustrated in FIG. 8, to minimize the interference with the first function module M1 in the state in which the second function module M2 is disposed, most of the avoidance part M21 may escape from the mid plate 7111*a* and protrude rearward through the rear notch part 7113*a*.

At this time, the left and right extension parts may be respectively inserted into and fixed to a ⊏-shaped accommodation space that is entirely formed by the mid plate 7111*a*, the front plate 7112 and the rear plate 7113. Substantially, the left and right extension parts of the second function module M2 is supported by the horizontal extension part 711 of the front upper frame 71.

To this end, the left-right width W11 of the mid plate 7111*a* may be greater than or at least the same as the entire left-right width of the second function module M2.

Additionally, the front-rear width W12 of the mid plate 7111*a* may be greater than or at least the same as the front-rear width of the extension part of the second function module M2.

Further, as described above, the holding hook M22 as a tool for fixing the second function module M2 to the front upper frame 71 may be provided at the extension part of the second function module M2.

The holding hook M22 may be formed in a way that protrudes rearward respectively from the rear surfaces of the left extension part and the right extension part.

The holding hook M22 may fix the rear sides of the extension parts of the second function module M2 while being inserted into a pair of holding holes 7113*b* of the above-described horizontal extension part 711.

Figure 9:
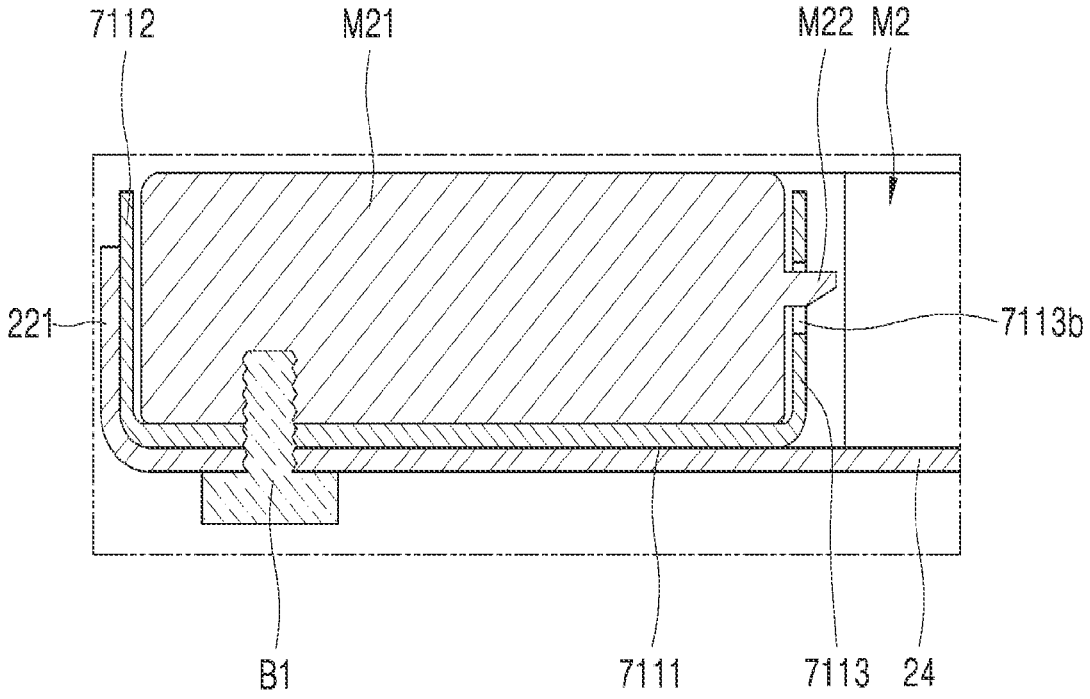
FIG. 9 is a cross-sectional view along A-A in FIG. 8.

During the insertion, to be readily inserted into the holing holes 7113*b*, the front end side of the holding hook M22, as illustrated in FIG. 9, may have a narrow cross section, and the cross section of the holding hook M22 may increase gradually toward the rear end portion of the holding hook M22.

For example, the upper end surface of the holding hook M22 may be a flat surface, and the lower end surface may be an inclined surface.

During a coupling, in the state which the rear surface of the extension part of the second function module M2 inclines further downward than the front surface, the holding hook M22 is inserted into the holding hole 7113*b*, and the front surface of the extension part rotates around the holding hook M22, such that the holding hook M22 is inserted into the holding hole 7113*b*.

In the state in which the holding hook M22 is completely inserted into the holding hole 7113*b*, the lower surface of the extension part is fastened to the mid plate 7111*a* through a module fastening bolt, as illustrated, to complete the assembly of the second function module M2.

At this time, the module fastening bolt may be disposed near the front surface of the extension part, and the rear surface of the extension part may be fixed through the holding hook M22, thereby preventing the up-down escape of the extension part effectively in the front-rear direction (the F-R direction), as illustrated.

The left extension part and the right extension part respectively require one module fastening bolt, minimizing the number of fastening bolts for fixing the second function module M2.

As illustrated in FIG. 9, the module fastening bolt may extend by passing through the upper surface 24 of the tub 20. At this time, the module fastening bolt may further fix the front upper frame 71 to the tub 20.

The front side frame 72, which is adjacent to the open front surface 22 of the tub 20 and attached to both the lateral surfaces of the tub 20, may include a first front side frame 721 disposed on a left surface 26 of the tub 20, and a second front side frame 722 disposed on a right surface 27 of the tub 20.

The first front side frame 721 is disposed on the left surface 26 of the tub 20 and reinforces the left edge portion of the open front surface 22 of the tub 20, and the second front side frame 722 is disposed on the right surface 27 of the tub 20 and reinforces the right edge portion of the open front surface 22 of the tub 20.

To this end, like the front upper frame 71, the first front side frame 721 and the second front side frame 722 may be formed into a beam that has a ⊏-shaped cross section in a direction perpendicular to the lengthwise direction thereof.

The first front side frame 721 and the second front side frame 722 may be respectively attached to the left surface 26 of the tub 20 and the right surface 27 of the tub 20 not only to reinforce the open front surface 22 of the tub 20 but also to support and fix other members that are not illustrated. The shapes of the first front side frame 721 and the second front side frame 722 may vary depending on the sorts and positions of members to be attached.

However, as described above, the upper end portion 7211*a* of the first front side frame 721 and the upper end portion 7221*a* of the second front side frame 722, each of which is coupled to each of the first perpendicular extension part 712 of the front upper frame 71 and the second perpendicular extension part 713 of the front upper frame 71, may have a symmetrical shape.

Figure 10:
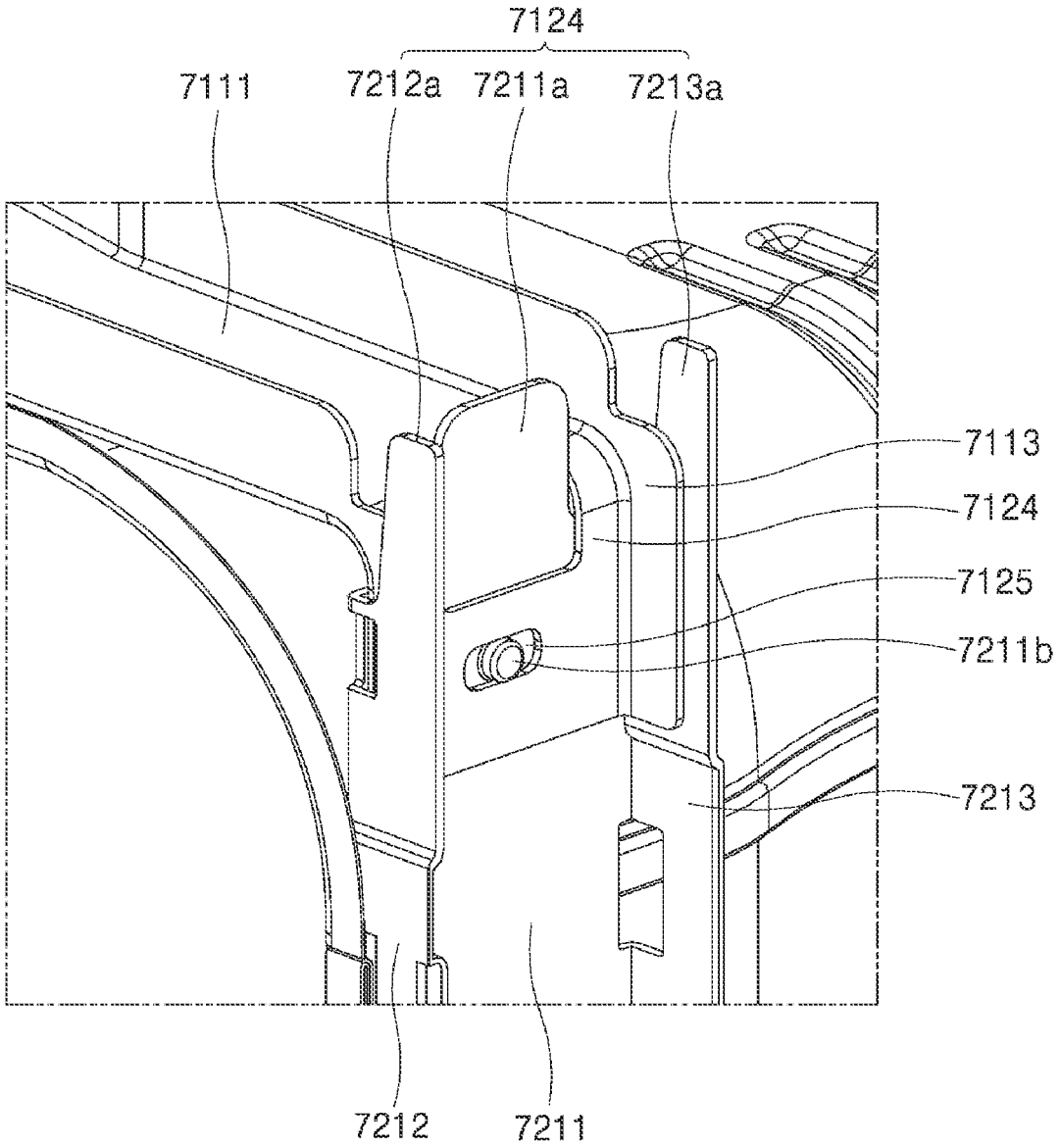
FIG. 10 is a partial enlarged view for describing a coupling relationship between a front upper frame and a first front side frame.
Figure 11:
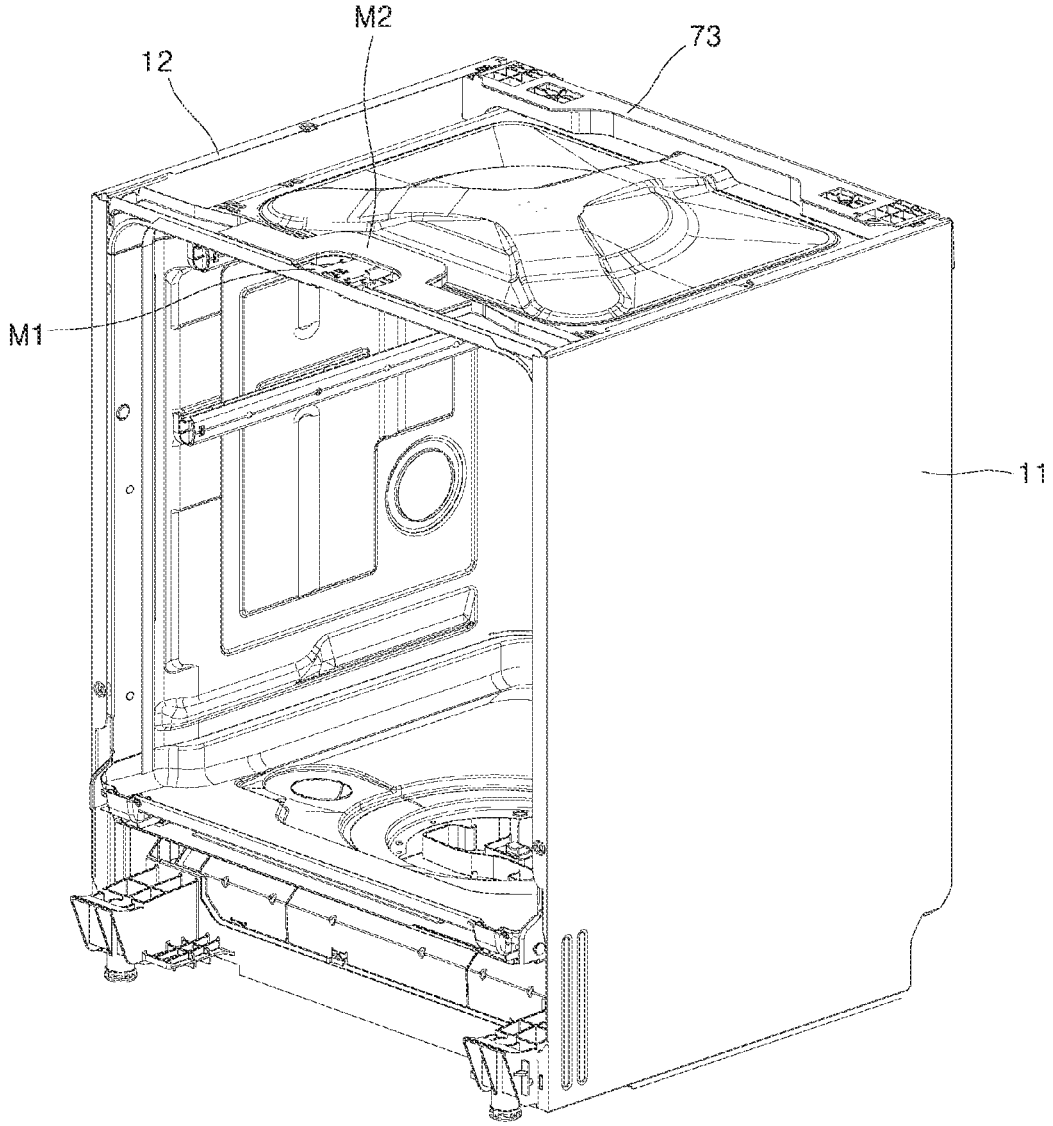
FIG. 11 is a perspective view showing the state in which a first side case and a second side case are coupled.

Referring to the first front side frame 721 of FIG. 10, the first front side frame 721 may include a first base palate 7211 that is formed into a flat plate and coupled to the left surface 26 of the tub 20, and a first front plate 7212 and a first rear plate 7213 that respectively bend from the front edge and rear edge of the first base plate 7211 and extend in the direction where the first front plate 7212 and the first rear plate 7213 become far from the tub 20.

The first base plate 7211 forms the bottom surface of a ⊏-shape, and corresponds to a portion directly attached and fixed to the left surface 26 of the tub 20. The upper end portion 7211*a* of the first base plate 7211, coupled to the above-described first perpendicular extension part 712, may remain separate from the tub 20.

As described above, the position determination bead 7211*b* into which the guide hole 7125 of the first perpendicular extension part 712 is inserted may be provided near the upper end portion 7211*a* of the first base plate 7211.

Additionally, the upper end portion 7211*a* of the first base plate 7211 may be formed into a protrusion that has a front-rear width narrow enough for the upper end portion 7211*a* to pass through the insertion hole 7124 of the first perpendicular extension part 712.

That is, the upper end portion 7211*a* of the first base plate 7211, formed into a protrusion, may have a width less than a width between the first front plate 7212 and the first rear plate 7213.

The first front plate 7212 and the first rear plate 7213 are integrated with the first base plate 7211, and respectively form the front surface and the rear surface of the ⊏-shape.

At this time, a width between the upper end portion 7212*a* of the first front plate 7212 and the upper end portion 7213*a* of the first rear plate 7213 may be greater than a width between the front plate 7122 of the first perpendicular extension part 712 and the rear plate 7123 of the first perpendicular extension part 712.

Since the width between the upper end portion 7212*a* of a first front side plate and the upper end portion 7213*a* of the first rear plate 7213 is defined as described above, the up-down (U-D direction) movement of the first perpendicular extension part 712 may be effectively guided at a time of a coupling of the first perpendicular extension part 712.

That is, the front upper frame 71 in one embodiment may be assembled to the tub 20 in the state in which the first front side plate and a second front side plate are assembled to the tub 20.

In the state in which the first front side plate and the second front side plate are assembled and fixed to the tub 20, the lower end portion of the first perpendicular extension part 712 may be inserted between the first front plate 7212 and the first rear plate 7213 of the first front side plate, and the lower end portion of the second perpendicular extension part 713 may be inserted between a second front plate 7222 and a second rear plate 7223 of the second front side plate.

In the process of inserting the lower end portion of the first perpendicular extension part 712 and the lower end portion of the second perpendicular extension part 713, the front upper frame 71 may be guide by the first front side frame 721 and the second front side frame 722 to make a horizontal movement entirely in the downward direction (the D-direction).

As the horizontal movement of the front upper frame 71 starts, the upper end portion 7211*a* of the first base plate 7211 and the upper end portion 7221*a* of the second base plate 7221 respectively pass through the insertion hole 7124, 7134.

As the front upper frame 71 makes a horizontal movement additionally in the downward direction (the D-direction) after the upper end portion 7211*a* of the first base plate 7211 and the upper end portion 7221*a* of the second base plate 7221 pass through the insertion hole 7124, 7134, the position determination bead is inserted into the guide hole 7125, 7135.

As the guide hole 7125, 7135 and the position determination bead are coupled in the process, the up-down (U-D direction) position of the front upper frame 71 may be accurately set, and the temporary assembly of the front upper frame 71 may be completed.

As the temporary assembly of the front upper frame 71 is completed, the front-rear (F-R direction) position of the front upper frame 71 may be set, and as the front-rear (F-R direction) position of the front upper frame 71 is completed, actual assembly between the front upper frame 71 and the tub 20 may proceed. The actual assembly may proceed based on the above-described methods such as welding and the like.

The front side frame 72 may also support the case 10 that forms the exterior of the dishwasher 1.

Specifically, the front side frame 72 may support and fix a first side case 11 and a second side case 12 that are disposed to cover both the lateral surfaces of the tub 20 respectively, with respect to the direction of gravity.

Herein, the first side case 11 covers the left surface 26 of the tub 20, and the second side case 12 covers the right surface 27 of the tub 20.

Hereafter, the support structure of a side case of the second front side frame 722 is described, and details of the second front side frame 722, the same as those of the first front side frame 721, are omitted.

Figure 12:
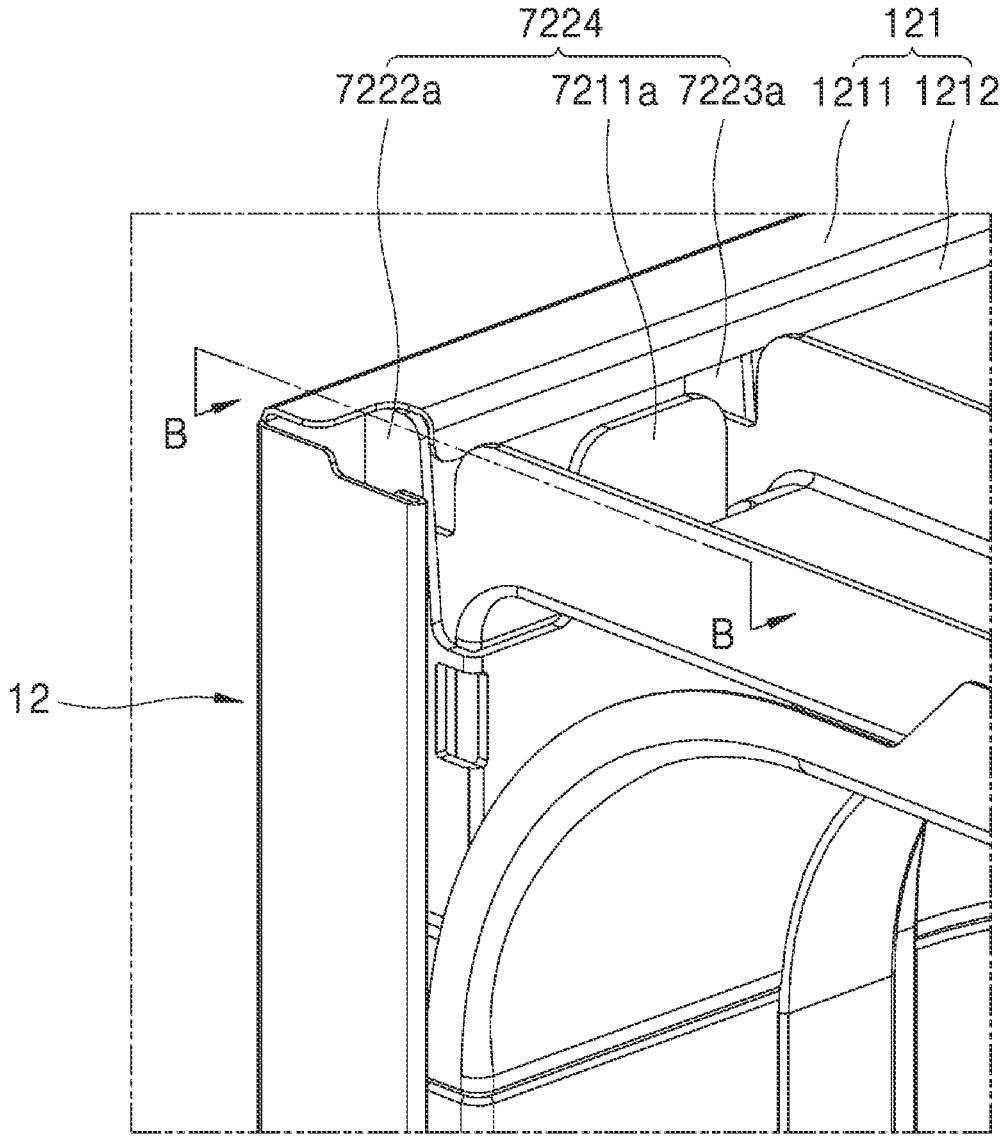
FIG. 12 is a partial enlarged view of FIG. 11.
Figure 13:
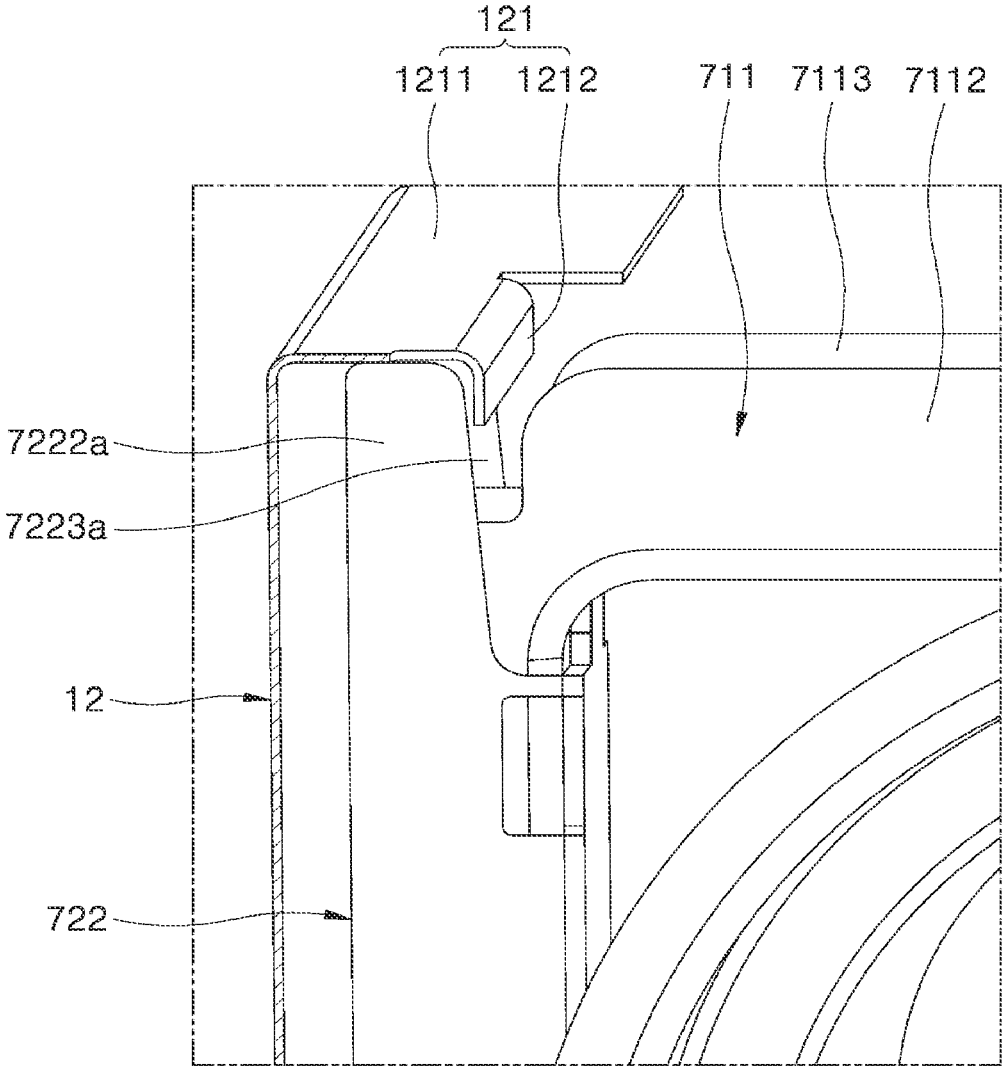
FIG. 13 is a cross-sectional view along B-B in FIG. 12.

Referring to FIGS. 12 and 13, an upper end portion 7222*a* of the second front plate 7222 of the second front side frame 722 and an upper end portion 7223*a* of the second rear plate 7223 of the second front side frame 722 may directly contact the second side case 12 and support the second side case 12 with respect to the direction of gravity.

As illustrated, the upper end portion 7222*a* of the second front plate 7222 has an upper end surface, the left-right (Le-Ri direction) height remains constant.

Likewise, the upper end portion 7223*a* of the second rear plate 7223 has an upper end surface, the left-right (Le-Ri direction) height remains constant.

That is, the upper end surface of the second front plate 7222 and the upper end surface of the second rear plate 7223 are formed to extend horizontally in parallel.

At this time, the upper end surface of the second front plate 7222 and the upper end surface of the second rear plate 7223 may have the same up-down (U-D direction) height.

An upper end holder 121 may be provide at the upper edge of the second side case 12, and coupled to the upper end surface of the second front plate 7222 and the upper end surface of the second rear plate 7223.

As illustrated, the upper end holder 121 may include a horizontal holder 1211 that extends horizontally from the upper edge of the second side case 12 toward the tub 20, and a perpendicular holder 1212 that is formed in a way that at least a portion of the horizontal holder 1211 bends in the downward direction (the D-direction).

The upper end surface of the second front plate 7222 and the upper end surface of the second rear plate 7223 directly contact the lower side surface of the horizontal holder 1211. Accordingly, a two-point support structure that supports the second side case 12 in the direction of gravity may be ensured.

As a result, the upper end surface of the second front plate 7222 and the upper end surface of the second rear plate 7223 may constitute a second side case support part 7224 that supports the second side case 12 (Though not illustrated, the upper end surface of the first front plate 7212 and the upper end surface of the first rear plate 7213 may be referred to as a first side case support part 7214 that supports the first side case 11.).

The perpendicular holder 1212 of the upper end holder 121 may prevent the second side case 12 from escaping from the second front plate 7222 and the second rear plate 7223 horizontally, in other words, in the direction where the second side case 12 becomes far from the tub 20.

As illustrated, the upper end portion 7222*a* of the second front plate 7222 and the upper end portion 7223*a* of the second rear plate 7223 may be detached or separated from the second base plate 7221.

In the illustrated state, the left side edge of the upper end portion 7222*a* of the second front plate 7222 is spaced a predetermined distance apart from the horizontal extension part 711 of the front upper frame 71.

Likewise, the left side edge of the upper end portion 7223*a* of the second rear plate 7223 is spaced a predetermined distance apart from the horizontal extension part 711 of the front upper frame 71.

The above-described spaces may be set identically, and the perpendicular holder 1212 of the upper end holder 121 may be inserted into the spaces.

After the perpendicular holder 1212 of the upper end holder 121 is inserted into the spaces, the leftward (Le-direction) movement of the second side case 12 may be stopped by the right side edge of the upper end portion 7222*a* of the second front plate 7222 and the right side edge of the upper end portion 7223*a* of the second rear plate 7223, and the rightward (Re-direction) movement of the second side case 12 may be stopped by the left side edge of the upper end portion 7222*a* of the second front plate 7222 and the left side edge of the upper end portion 7223*a* of the second rear plate 7223.

That is, the upper end portion 7222*a* of the second front plate 7222 and the upper end portion 7223*a* of the second rear plate 7223 may function as a stopper that stops the left-right (Le-Ri direction) movement of the second side case 12.

Additionally, the left side edge of the upper end portion 7222*a* of the second front plate 7222 and the left side edge of the upper end portion 7223*a* of the second rear plate 7223 may be formed into inclined surfaces that ease the entry of the perpendicular holder 1212 of the upper end holder 121.

As illustrated, the inclined surfaces may have a slant angle at which the inclined surfaces approach the tub 20 gradually further toward the downward direction (D-direction).

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiments.

[Description of reference numerals]

| | |
|---|---|
| 1: Dishwasher | 10: Case |
| 20: Tub | 30: Door |
| 40: Driving part | 50: Storage part |
| 60: Spray part | 70: Tub frame |
| 90: Base | |

The invention claimed is:

1. A dishwasher, comprising:

a case;

a tub that is accommodated in the case and defines a wash space, the tub having a front surface that is open; and a front upper frame that is disposed above an upper surface of the tub and supports an upper end of the front surface of the tub, the front upper frame comprising:

a horizontal extension that is coupled to the upper surface of the tub and extends across the tub in a left-right direction, a first perpendicular extension that extends downward from a left end portion of the horizontal extension, and a second perpendicular extension that extends downward from a right end portion of the horizontal extension, wherein the horizontal extension comprises a base plate that has a flat plate shape and is attached to the upper surface of the tub, wherein a front-rear width of the base plate is less than a left-right length of the base plate, wherein the base plate comprises:

a mid plate disposed between the left end portion of the horizontal extension and the right end portion of the horizontal extension, and a side plate disposed between the mid plate and the left end portion of the horizontal extension or disposed between the mid plate and the right end portion of the horizontal extension, wherein the front-rear width of the base plate includes (i) a first width that is defined by and maintained along the mid plate and (ii) a second width that is defined by and maintained along the side plate, and wherein the first width is greater than the second width.

2. The dishwasher of claim 1, wherein the first perpendicular extension is curved from the left end portion of the horizontal extension, and wherein the second perpendicular extension is curved from the right end portion of the horizontal extension.

3. The dishwasher of claim 1, wherein the horizontal extension further comprises:

a front plate curved upward from a front edge of the base plate; and a rear plate curved upward from a rear edge of the base plate upward.

4. The dishwasher of claim 3, wherein the tub comprises an upward extension surface that extends upward from an upper edge of the front surface of the tub and is in contact with the front plate of the horizontal extension.

5. The dishwasher of claim 4, wherein the side plate comprises:

a left side plate disposed between the mid plate and the left end portion of the horizontal extension; and a right side plate disposed between the mid plate and the right end portion of the horizontal extension.

6. The dishwasher of claim 5, wherein the base plate further comprises:

a left connecting plate that is disposed between the mid plate and the left side plate and connects the mid plate to the left side plate; and a right connecting plate that is disposed between the mid plate and the right side plate and connects the mid plate to the right side plate, and wherein a front-rear width of each of the left connecting plate and the right connecting plate increases from the second width to the first width along a direction toward the mid plate.

7. The dishwasher of claim 3, wherein the front plate defines a front opening, and wherein the base plate defines a front notch at a front edge of the mid plate, the front notch being open forward to the front opening of the front plate.

8. The dishwasher of claim 7, wherein the rear plate defines a rear opening, and wherein the based plate further defines a rear notch at a rear edge of the mid plate, the rear notch being open rearward toward the rear opening of the rear plate.

9. The dishwasher of claim 8, wherein a left-right width of the rear notch is greater than a left-right width of the front notch.

10. The dishwasher of claim 9, further comprising:

a door disposed at a front of the tub and configured to open and close the front surface of the tub; and at least one function module supported by the mid plate and configured to lock the door, sense a position of the door, or automatically open the door.

11. The dishwasher of claim 10, wherein the at least one function module comprises:

a first function module configured to perform at least one function among a plurality of functions for locking the door, sensing the position of the door, and automatically opening the door, and wherein at least a portion of the first function module is exposed forward through the front notch.

12. The dishwasher of claim 11, wherein the at least one function module further comprises:

a second function module configured to perform at least another function among the plurality of functions for locking the door, sensing the position of the door, and automatically opening the door, and wherein at least a portion of the second function module is exposed rearward through the rear notch.

13. The dishwasher of claim 12, wherein the second function module comprises a holding hook that protrudes rearward and fixes the second function module to the front upper frame, and wherein the rear plate defines a holding hole that receives the holding hook and is coupled to the holding hook.

14. The dishwasher of claim 3, wherein the first perpendicular extension comprises a first extension plate that is curved from a left end portion of the base plate, the first extension plate defining a first guide hole that passes through the first extension plate, and wherein the second perpendicular extension comprises a second extension plate that is curved from a right end portion of the base plate, the second extension plate defining a second guide hole that passes through the second extension plate.

15. The dishwasher of claim 14, wherein each of the first guide hole and the second guide hole has an elongated shape having a front-rear width that is greater than an up-down width.

16. The dishwasher of claim 15, wherein the first extension plate further defines a first insertion hole that passes through the first extension plate and is disposed above the first guide hole, the first insertion hole having a rectangle shape and defining an opening area greater than the first guide hole, wherein an upper edge of the first insertion hole extends to the base plate through the left end portion of the horizontal extension, wherein the second extension plate further defines a second insertion hole that passes through the second extension plate and is disposed above the second guide hole, the second insertion hole having a rectangle shape and defining an opening area greater than the second guide hole, and wherein an upper edge of the second insertion hole extends to the base plate through the right end portion of the horizontal extension.

17. The dishwasher of claim 16, further comprising:

a first front side frame that is disposed at a left surface of the tub and supports a left end of the front surface of the tub, the first front side frame comprising a first position determination bead that is inserted into the first guide hole; and a second front side frame that is disposed at a right surface of the tub and supports a right end of the front surface of the tub, the second front side frame comprising a second position determination bead that is inserted into the second guide hole.

18. The dishwasher of claim 17, wherein the first front side frame further comprises:

a first base plate that is fastened to the left surface of the tub and has a flat plate shape;

a first front plate that is curved from a front edge of the first base plate and extends in a first direction away from the tub; and a first rear plate that is curved from a rear edge of the first base plate and extends in the first direction away from the tub, wherein an upper end portion of the first base plate passes through the first insertion hole and protrudes upward through the first insertion hole, wherein the second front side frame further comprises:

a second base plate that is fastened to the left surface of the tub and has a flat plate shape, a second front plate that is curved from a front edge of the second base plate and extends in a second direction away from the tub opposite to the first direction, and a second rear plate that is curved from a rear edge of the second base plate and extends in the second direction away from the tub, and wherein an upper end portion of the second base plate passes through the second insertion hole and protrudes upward through the second insertion hole.

19. The dishwasher of claim 18, wherein the case comprises:

a first side case that covers the left surface of the tub and is coupled to an upper end portion of the first front plate and an upper end portion of the first rear plate; and a second side case that covers the right surface of the tub and is coupled to an upper end portion of the second front plate and an upper end portion of the second rear plate, wherein the first side case is supported by the upper end portion of the first front plate and the upper end portion of the first rear plate in a direction of gravity, and wherein the second side case is supported by the upper end portion of the second front plate and the upper end portion of the second rear plate in the direction of gravity.

* * * * *